US006199241B1

(12) United States Patent
Anumah

(10) Patent No.: US 6,199,241 B1
(45) Date of Patent: Mar. 13, 2001

(54) BATHTUB BRUSH

(76) Inventor: Carl K. Anumah, 1410 W. Parkchester Rd., 5C, Bronx, NY (US) 10462

( * ) Notice: Subject to any disclaimer, the term of this patent is extended or adjusted under 35 U.S.C. 154(b) by 0 days.

(21) Appl. No.: 09/228,952

(22) Filed: Jan. 12, 1999

(51) Int. Cl.[7] ..... A46B 9/00; A46B 9/02
(52) U.S. Cl. ..... 15/160; D32/50; 15/145
(58) Field of Search ..... 15/160, 164, 210.1, 15/146, 145, 159.1; D32/50; D04/130

(56) References Cited

U.S. PATENT DOCUMENTS

| | | | | |
|---|---|---|---|---|
| D. 312,156 | | 11/1990 | Dowlat . | |
| D. 321,793 | | 11/1991 | Bryant . | |
| D. 351,948 | | 11/1994 | Getchell . | |
| 713,549 | * | 11/1902 | Young . | |
| 1,509,381 | * | 9/1924 | Townsend . | |
| 1,749,733 | * | 3/1930 | Cave et al. . | |
| 2,855,618 | * | 10/1958 | Jones | 15/160 |
| 3,076,217 | | 2/1963 | Scholl . | |
| 3,402,413 | | 9/1968 | Gibellina . | |
| 3,761,990 | | 10/1973 | Lynn . | |
| 4,082,186 | * | 4/1978 | Chirumbolo | 15/145 |
| 4,433,931 | | 2/1984 | Malish et al. . | |
| 4,479,277 | | 10/1984 | Gilman et al. . | |
| 4,554,699 | * | 11/1985 | Simmons | 15/160 |
| 4,783,868 | * | 11/1988 | O'Callaghan | 15/160 |
| 5,182,830 | | 2/1993 | Viola . | |
| 5,375,287 | | 12/1994 | Dillahunt . | |
| 5,487,397 | * | 1/1996 | Bean | 15/160 |
| 5,568,668 | | 10/1996 | Margolin . | |

FOREIGN PATENT DOCUMENTS

| | | | |
|---|---|---|---|
| 1123604 | | 9/1956 | (FR) . |
| 506945 | * | 6/1939 | (GB) ..... 15/160 |
| 756581 | | 9/1956 | (GB) . |

* cited by examiner

*Primary Examiner*—Gary K. Graham
(74) *Attorney, Agent, or Firm*—Richard C. Litman

(57) ABSTRACT

A bathtub brush having a lower bristled surface with a flat central portion, upwardly angled, flat end portions, and convex curved surfaces between the central and end portions. The curved portions are configured to conform to the rounded corner between the bottom and sides of a bathtub, thereby allowing simultaneous, effective cleaning of the bottom, sides, and rounded corner therebetween. The brush includes an elongated handle to allow the user to stand while cleaning the tub.

4 Claims, 4 Drawing Sheets

BATHTUB BRUSH

BACKGROUND OF THE INVENTION

1. Field of the Invention

The present invention relates to scrub brushes. Specifically, the invention is a scrub brush having an outwardly curved bristled surface conforming to the rounded corners between the bottom and sides of a bathtub.

2. Description of the Related Art

Several other inventors have proposed many different improvements for brushes, directed towards a wide variety of purposes. However, no one within the knowledge of the present inventor has developed a brush having an outwardly curved bristled surface at each end, corresponding to the rounded corners inside a bathtub, and used in conjunction with an elongated handle.

U.S. Pat. No. 312,156, issued to Jill M. Dowlat on Nov. 13, 1990, shows a bath tub mop having a sponge bottom and an elongated handle.

U.S. Pat. No. Des. 321,793, issued to William C. Bryant on Nov. 26, 1991, shows a push broom having a forward extending flange at each front corner of the bristle portion.

U.S. Pat. No. Des. 351,948, issued to William W. Getchell on Nov. 1, 1994, shows a pool cleaning broom with a bristle portion having slightly upward angled ends.

U.S. Pat. No. 3,076,217, issued to Leidy G. Schollf on Feb. 5, 1963, shows a removable brush head cover with a threaded handle nut. The threaded nut will thread the end of a smooth wood handle when the handle is screwed into the nut, thereby securing the handle to the brush.

U.S. Pat. No. 3,402,413, issued to Michael C. Gibellina on Sep. 24, 1968, describes a swimming pool brush guide. The guide pushes water upward as the brush is pushed forward, resulting in a downward force applied on the brush by the water. The guide thereby holds the brush against the bottom of the pool during brushing.

U.S. Pat. No. 3,761,990, issued to David Lynn on Oct. 2, 1973, describes a corner brush. The brush has an L-shaped handle with a rounded corner, and bristles angled towards the corner.

U.S. Pat. No. 4,433,931, issued to Terrance J. Malish et al. on Feb. 28, 1984, describes an adaptor for connecting a broom to a handle.

U.S. Pat. No. 4,479,277, issued to Thomas Gilman et al. on Oct. 30, 1984, describes a scrub brush having pivotally mounted picks.

U.S. Pat. No. 5,182,830, issued to John Viola on Feb. 2, 1993, describes a truck mounted pavement sweeping brush. The brush attaches to a snow plow mounting apparatus, and includes L-shaped ends for sweeping the curb as well as the street.

U.S. Pat. No. 5,375,287, issued to Joan C. Dillahunt on Dec. 27, 1994, describes a scrub brush having an elongated tip with bristles protruding at various angles to allow brushing cornered surfaces.

U.S. Pat. No. 5,568,668, issued to Michael Margolin on Oct. 29, 1996, describes a broom handle.

French Pat. No. 1,123,604, published on Sep. 25, 1956, describes a broom.

U.K. Pat. No. 756,581, published on Sep. 5, 1956, describes a brush having rubber bands located in grooves at the ends to protect furniture around the brush from damage.

None of the above inventions and patents, taken either singularly or in combination, is seen to describe the instant invention as claimed. Thus a bathtub brush solving the aforementioned problems is desired.

SUMMARY OF THE INVENTION

The invention is an improved brush for cleaning a bathtub. The brush has a bristled bottom surface having a flat central section, upwardly angled, flat end sections, and convex curved sections between the center and end sections. The curved sections are dimensioned and configured to correspond to the rounded corner between the bottom and sides of a bathtub. The brush thereby allows simultaneous, effective cleaning of the bathtub's bottom, sides, and the rounded corner therebetween.

The brush has an elongated handle to permit its use while standing, preventing the discomfort resulting from kneeling on the floor while cleaning the bathtub. The joint between the brush and the handle is preferably either a friction fit or a threaded connection.

Accordingly, it is a principal object of the invention to provide an improved brush for cleaning a bathtub.

It is another object of the invention to provide a brush having curved bristled surfaces corresponding to the rounded corners between the bottom and sides of a bathtub.

It is a further object of the invention to provide a brush having an elongated handle.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
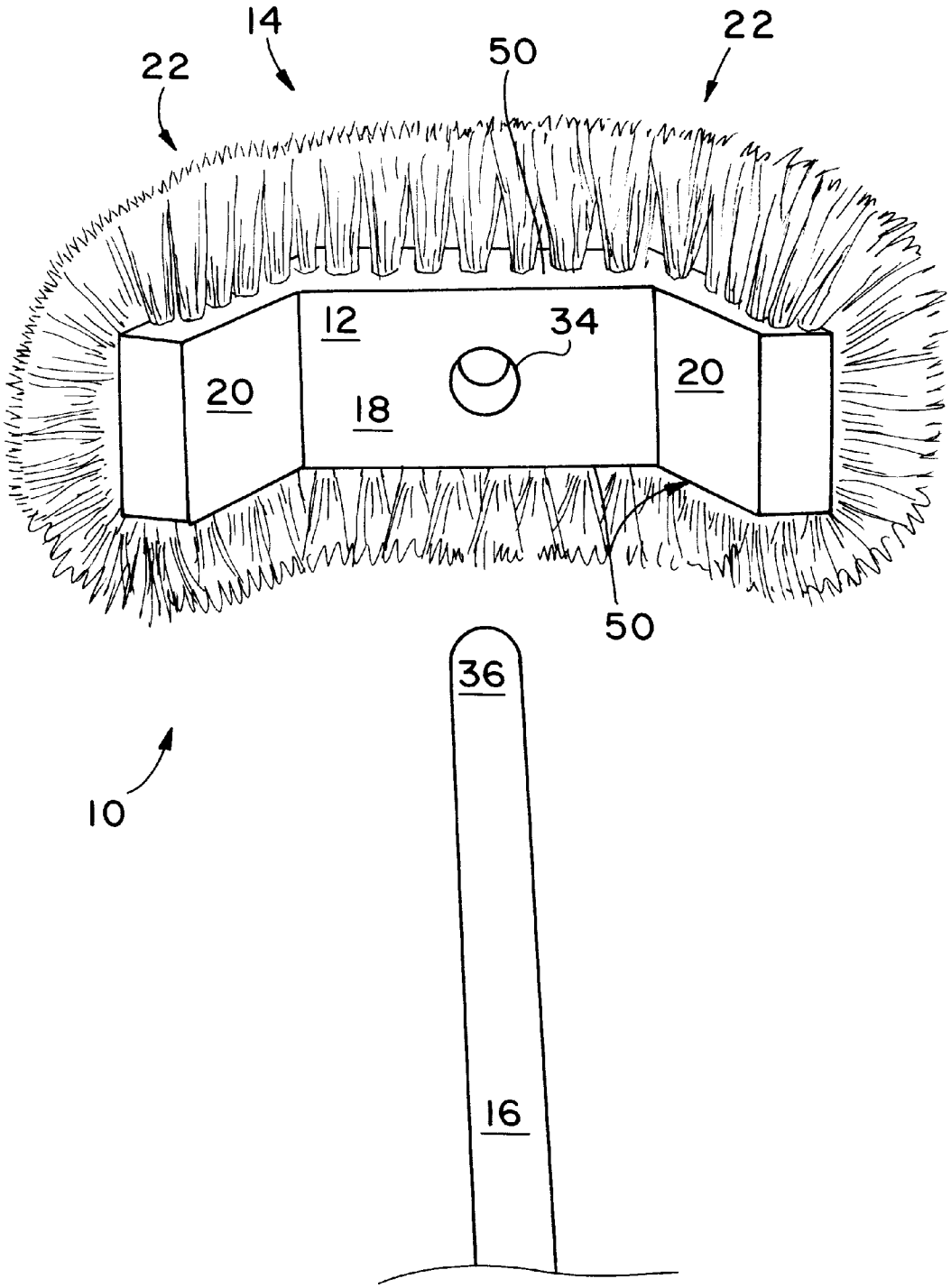
FIG. 2 is an exploded perspective view of a bathtub brush and elongated handle according to the present invention, showing a friction fitting between the brush and handle.
Figure 3:
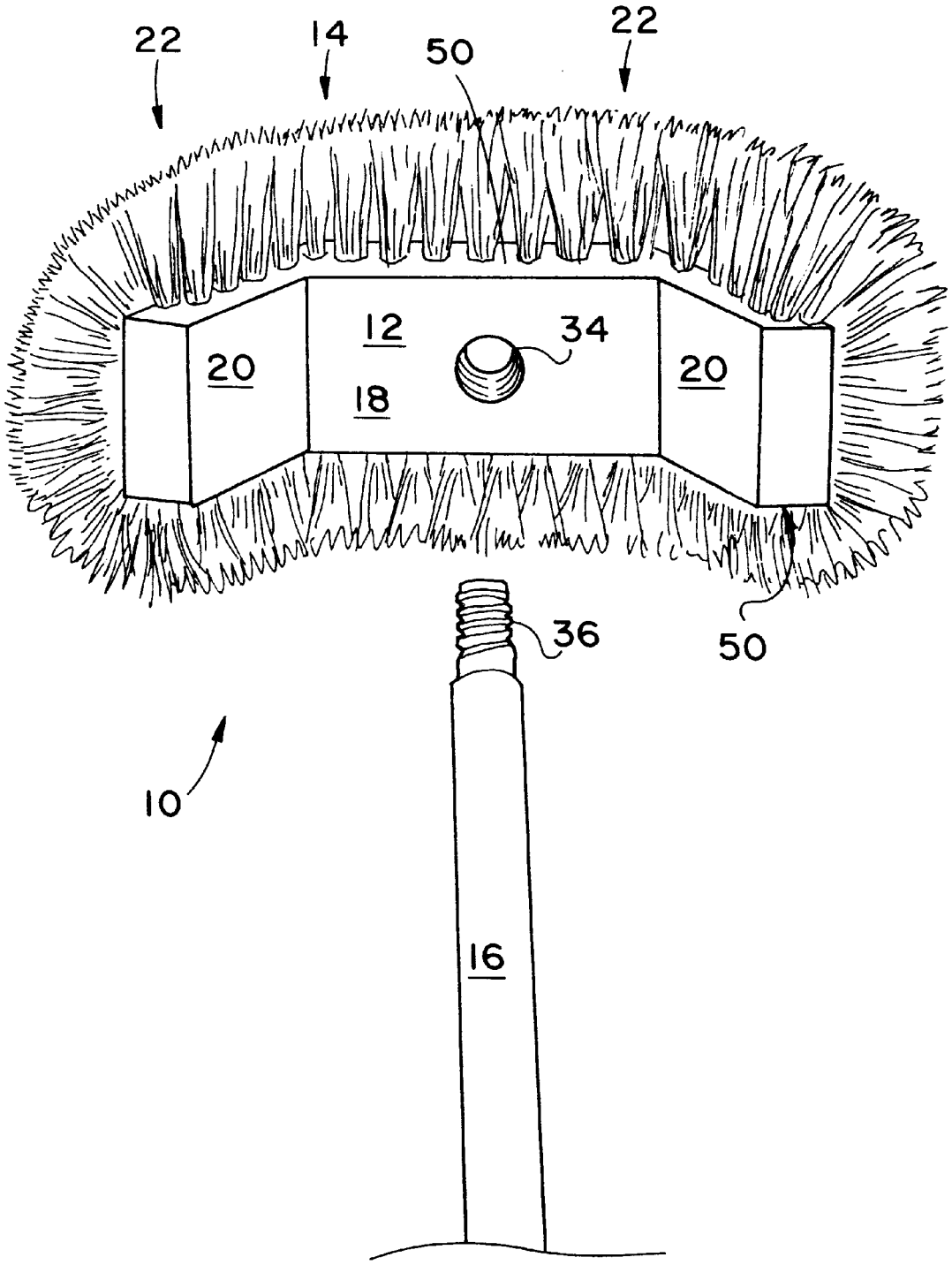
FIG. 3 is an exploded perspective view of a bathtub brush and elongated handle according to the present invention, showing a brush having a threaded hole and a corresponding handle with a threaded end.

The present invention is a brush for cleaning a bathtub. Referring to FIGS. 2 and 3, the brush 10 includes a base 12 having a bristled surface 14, and an elongated handle 16.

Figure 1:
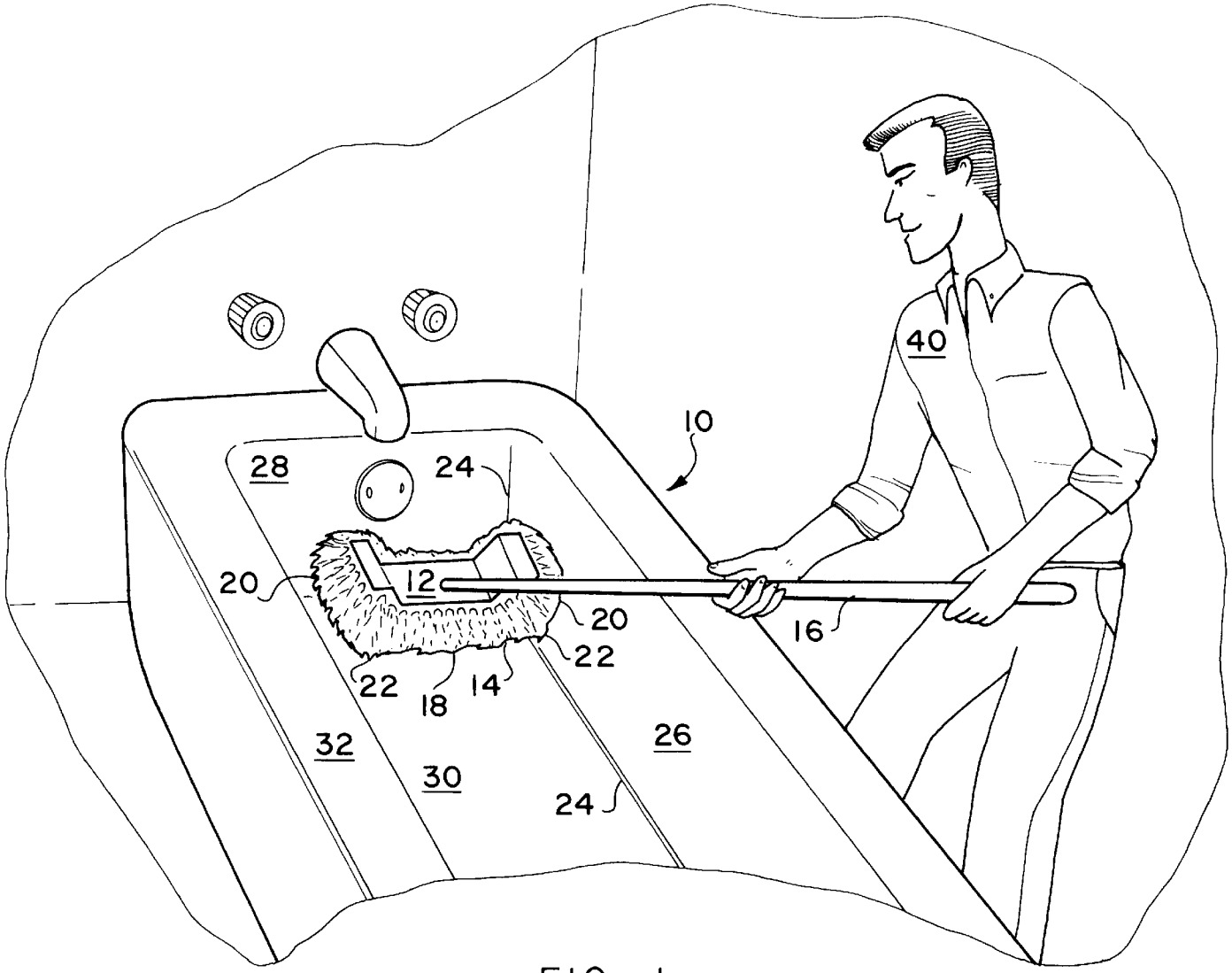
FIG. 1 is an environmental, perspective view of a bathtub brush according to the present invention.

The base 12 includes a flat central portion 18, and a pair of upwardly angled end portions 20. The bristled surface 14, on the bottom of base 12, forms a convex curve 22 between central portion 18 and end portions 20. Referring to FIG. 1, the convex curve 22 is dimensioned and configured to conform to the rounded corners 24 between the sides 26, ends 28, and bottom 30 of bathtub 32.

Figure 4:
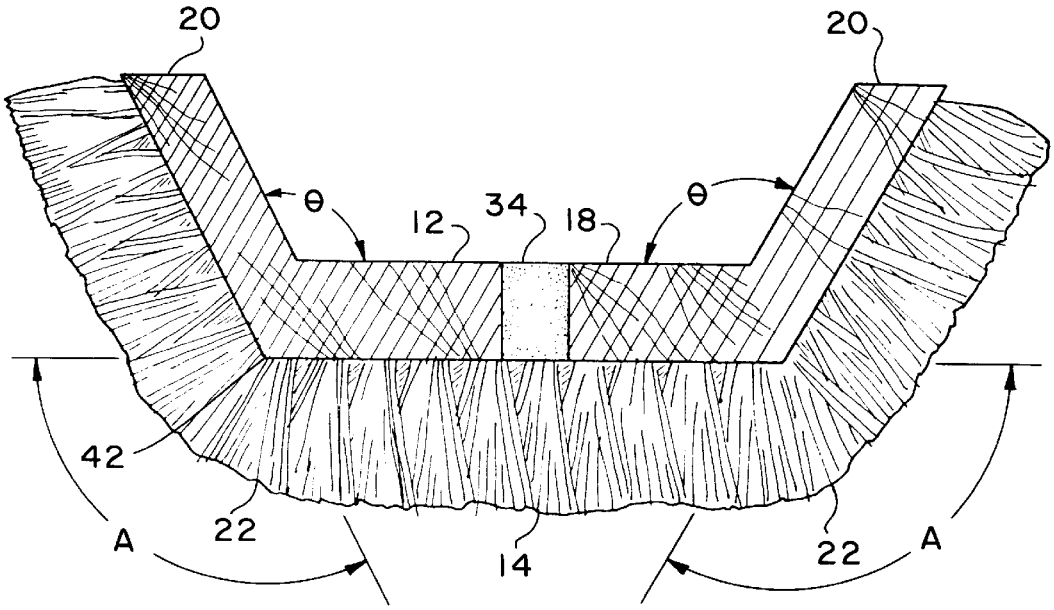
FIG. 4 is a cross sectional view of a bathtub brush according to the present invention.

The specific structure of base 12 which provides for bristles 14 having the convex curve 22 is best seen in FIG. 4. The end sections 20 of base 12 project upward at an obtuse angle θ from the central portion 18 of base 12. A preferred and suggested range of values for obtuse angle θ is from 115° to 120°, although somewhat smaller or larger angles θ may be used successfully. The preferred length for central section 18 between the each end section 20 defined by the apex of angle θ is about 4 inches. The preferred length for end section 20 defined from the apex of angle θ to the terminus of the end section 20 is about 2 inches.

As can readily be determined by basic geometric principles, angle θ is equal to angle A. Angle A has an apex defining a corner 42 of the solid base 12. The preferred length for central section 18 between the each end section 20 defined by the apex of angle A is about 6 inches. The preferred length for end section 20 defined from the apex of angle A to the terminus of the end section 20 is about 3 inches. However, note that the thickness of the base 12 may vary as dictated by manufacturing processes to firmly embed the bristles 14 into the base 12, thereby altering slightly the length defined between the apices of angles A and from apex to terminus. Moreover, the actual corner 42 may also be rounded as desired and dictated by manufacturing processes.

Unlike the corner 42, however, bristles 14 should not form a sharp corner. Rather, the bristles 14 of center section 18, which have been compressed together when inserted into the base according to standard brush manufacturing techniques, bend outward towards the bristles 14 of end sections 20 forming an arc between the legs of angle A. Likewise, bristles 14 of end sections 20 bend away from each other and towards the center section 18. The result is that the bristles 14 form a continuous convex curved surface 22, defined by the arc of angle A. The actual length of the arc is determined by the diametric distance from the apex of angle A, i.e. the length of the bristles 14. This curved surface 22 conforms to the rounded corners 24 of bathtub 32, shown in FIG. 1.

Referring back to FIGS. 2 and 3, base 12 includes hole 34 for receiving elongated handle 16. As shown in FIG. 2, the end 36 of handle 16 may be smooth, being secured within hole 34 by friction. Alternatively, as shown in FIG. 3, end 36 of handle 16 may be threaded, fitting within a threaded hole 34. In addition, the base 12 has opposite side edges 50 extending continuously from one end section 20 along the central section 18 to the other end section 20. Additional bristles 14 extend from these opposite side edges and continuously compliment the convex curved surface 22 of the bottom of base 12.

Referring back to FIG. 1, the handle 16 of brush 10 allows user 40 to clean bathtub 32 while standing. The central portion 18, end portion 20, and curve 22 of bristled surface 14 are in contact simultaneously with bottom 30, side 26, and rounded corner 24 of bathtub 32. The ability to reach all surfaces of the bathtub 32 provides for fast, effective cleaning.

It is to be understood that the present invention is not limited to the embodiments described above, but encompasses any and all embodiments within the scope of the following claims.

I claim:

1. A brush for a bathtub, the bathtub having a pair of sides, a pair of ends, a bottom, and rounded corners therebetween, said brush being dimensioned and configured to conform to the rounded corners of the bathtub and consisting essentially of:

a base having a central portion, and a pair of upwardly angled end portions, each portion defining a top surface, a bottom surface and opposite side edges, each one of said pair of upwardly angled end portions forms an obtuse angle with respect to said central portion of said base, each said bottom surface and each said opposite side edge having bristles extending outwardly therefrom, said bristles defining a lower bristled surface having a convex curve between said central portion and each one of said pair of upwardly angled end portions and extending along said opposite side edges, wherein each said obtuse angle corresponds with a respective said convex curve defined by said lower bristle surface and a hole in said top surface; and an elongated handle having a lower end, said lower end being dimensioned and configured to fit securely within said hole.

2. The bathtub brush according to claim 1, wherein each said obtuse angle measures from 115° to 120°.

3. The bathtub brush according to claim 1, wherein said elongated handle is secured within said hole by a friction fit.

4. The bathtub brush according to claim 1, wherein said elongated handle is secured within said hole by a threaded connection.

* * * * *